United States Patent [19]

Shuei-Lai

[11] Patent Number: 5,054,797

[45] Date of Patent: Oct. 8, 1991

[54] ROLLER BRACKET STRUCTURE FOR A SKATEBOARD

[76] Inventor: Tsai Shuei-Lai, No. 6, 21 Alley, 306 Lane, 2 Sec, Tai-Lin Rd, Tai-Shan Town, Taipei Hsien, Taiwan

[21] Appl. No.: 506,092

[22] Filed: Apr. 9, 1990

[51] Int. Cl.[5] ..... B62M 1/00

[52] U.S. Cl. ..... 280/11.28; 280/87.042

[58] Field of Search ..... 280/87.042, 87.021, 280/11.27, 11.28

[56] References Cited

U.S. PATENT DOCUMENTS 3,862,763 1/1975 Ware ..... 280/11.28

4,103,917 8/1978 Widolf ..... 280/11.28

*Primary Examiner*—Andres Kashnikow

*Assistant Examiner*—Richard Camby

*Attorney, Agent, or Firm*—Bacon & Thomas

[57] ABSTRACT

An improved roller bracket structure for a skateboard mainly constituted by an integral body made of nylon, a fixed block made of PU and a shaft. The integral body has an upper portion provided with a passage for receiving the shaft and the upper portion extends in a first direction along an inclined surface to the edge of the body for supporting the force and torque exerted thereon by the player, and extends in a second direction to form a nose-shaped portion for facilitating the control for the forward and sideward motions. Further, the fixed block is fitted on the body to buff and control the nose-shaped portion and maintain a safe operating condition.

2 Claims, 3 Drawing Sheets

ROLLER BRACKET STRUCTURE FOR A SKATEBOARD

This invention relates to an improved roller bracket structure and in particular to one which is originally created, feasible to safely use and economical to produce. The roller bracket structure includes an integral nylon body on which there is an upper portion provided with a passage therethrough for receiving the shaft and extends in a first direction along an inclined surface portion to the edge of the body for supporting the force and torque exerted thereon by the player, and extends in a second direction to form a nose-shaped surface for facilitating the control for the forward and sideward motions. Further, the fixed PU block is fitted on the body to buff and control the nose-shaped surface to maintain a safe operating condition.

It is found that the commonly used roller bracket structure is composed of a body, a seat, a locking rod structure for connecting the body and the seat, and a rod stand for steadying the seat. Hence, it is uneconomical for component consumption and assembly. Further, the arrangement of parts is unreasonable and so it is impossible to assure the safety of the player, thereby often causing injuries.

FIG. 1 shows a prior art roller bracket structure for a skateboard, the drawbacks of which are described as follows:

1. The assembly of the roller bracket is complicated, requiring a lot of material and time.

2. It is necessary to further provide a protection cover to the roller bracket because the body, the seat and the locking rod structure will easily injure the player and, in addition, the locking rod structure will often be blocked by the impedance to reverse the skateboard.

3. The structure of the prior art roller bracket is unmovable, so a rather large force is required in order to operate the skateboard.

It is, therefore, an object of the present invention to provide an improved roller bracket structure which will obviate the above-mentioned drawbacks.

The primary object of the present invention is to provide an improved roller bracket structure for a skateboard which utilizes two smooth and resilient surfaces to replace complicated and hazardous structure of the prior art so as to prevent injury to the player.

Another object of the present invention is to provide an improved roller bracket structure for a skateboard which is simplified in construction and economical to produce by reducing the number of components.

A further object of the present invention is to provide an improved roller bracket structure for a skateboard which has a specially designed nose-shaped surface and a resilient space for producing torque so that it is easy to drive the rollers forward by exerting a forward force on the skateboard thereby facilitating the operation of the skateboard.

1. DRAWINGS

2. NUMERICALS

1A SEAT
2A PROTECTION COVER
11A LOCKING ROD STRUCTURE
12A STAND
100 INCLINED SURFACE
1 BODY
11 PASSAGE
12 NOSE-SHAPED PORTION
13 CUSHIONING SEAT
131 RECESS
14 CONVEX PORTION
15 HOLE
16 UPPER PORTION
2 SHAFT
3 FIXED BLOCK
31 RECESS
32 HOLE
33 SLOT

Figure 1:
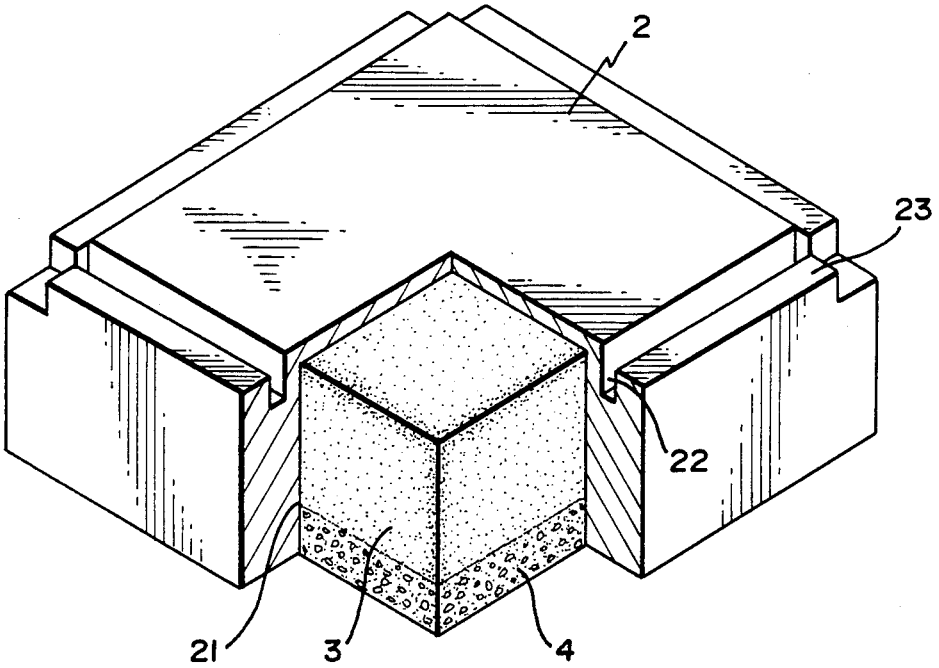
FIG. 1 is a perspective and partially exploded view showing the structure of a prior art roller bracket for a skateboard.

With reference to FIG. 1, there is shown the structure of a prior art roller bracket for a skateboard which is composed of a body, a seat 1A, a stand 12A and a locking rod 11A. The roller bracket is further provided with a protection cover 2A for preventing the player from being injured by the metal rod mounted on the seat 1A and the bolt of the locking rod structure 11A. However, since the protection cover 2A is composed of two pieces and only one of them is fitted on the metal rod of the seat 1A, it is easily detached from roller bracket and may cause injuries. Actually, the locking rod structure 11A should be made flexible while the stand 12A used to steady the movement of the seat 1A.

Figure 2:
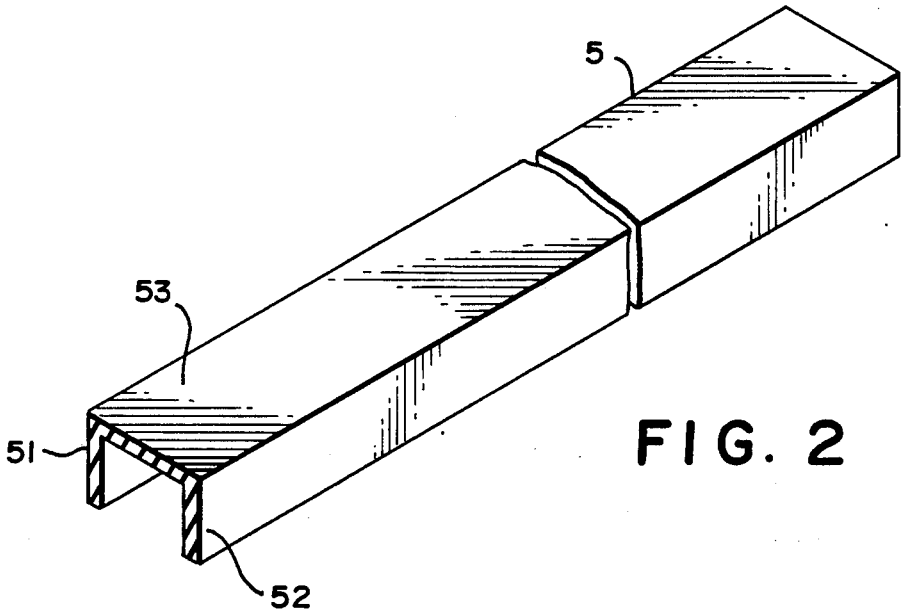
FIG. 2 is a perspective view of a roller bracket according to the present invention.
Figure 3:
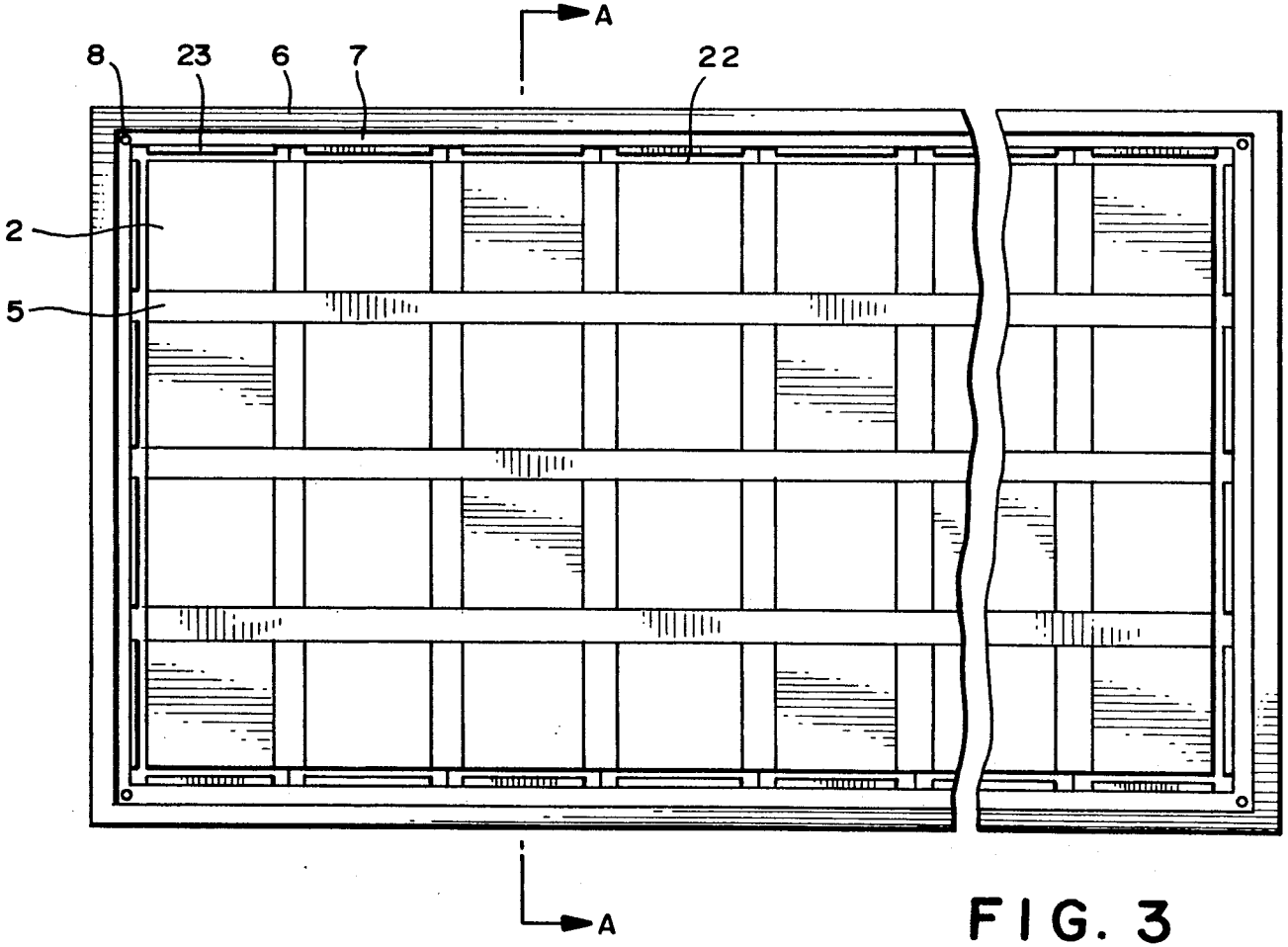
FIG. 3 is an exploded perspective view of the invention roller bracket.
Figure 4:
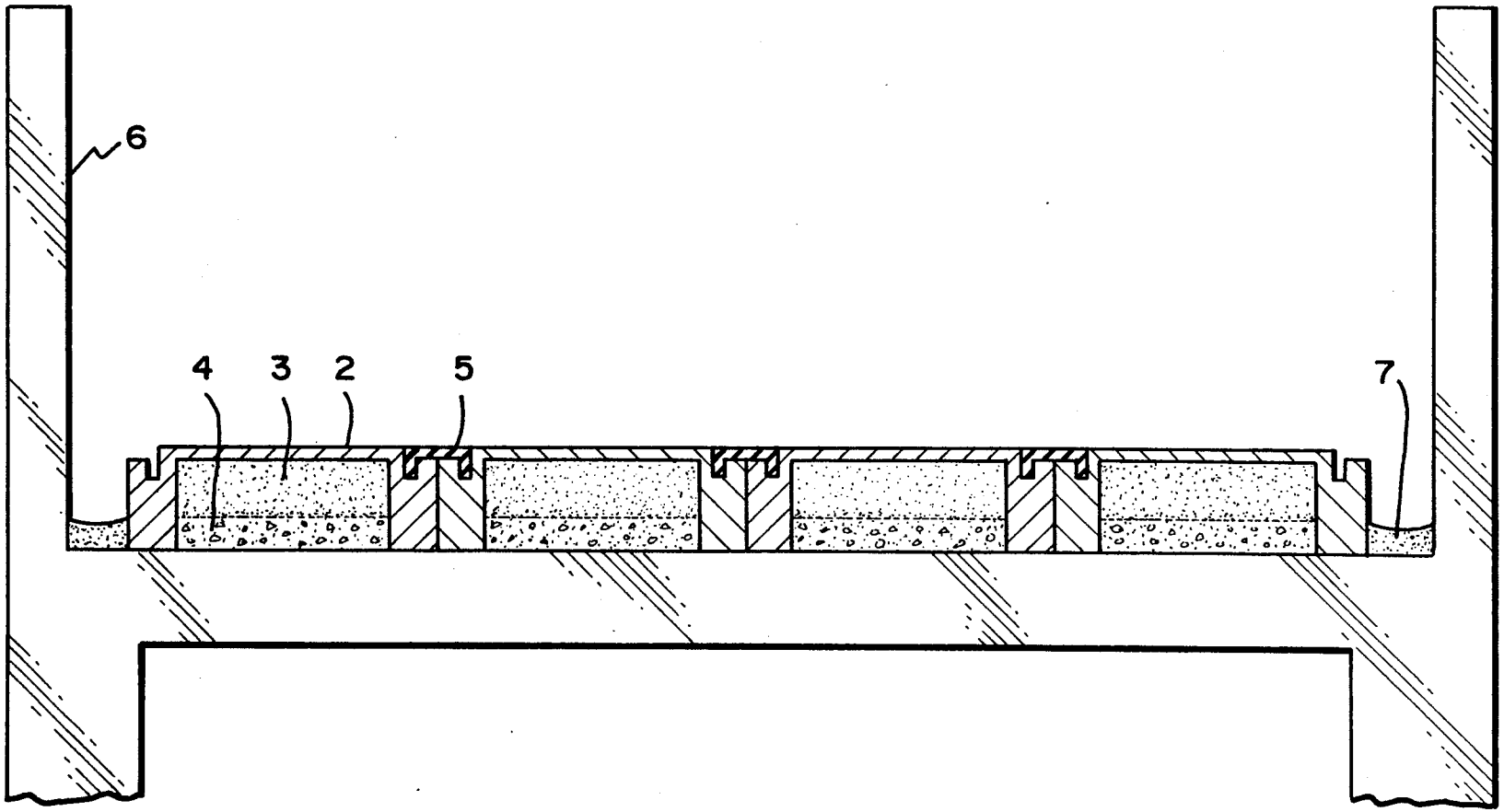
FIG. 4 is a side elevation view, partly in section, of the invention roller bracket.
Figure 1:
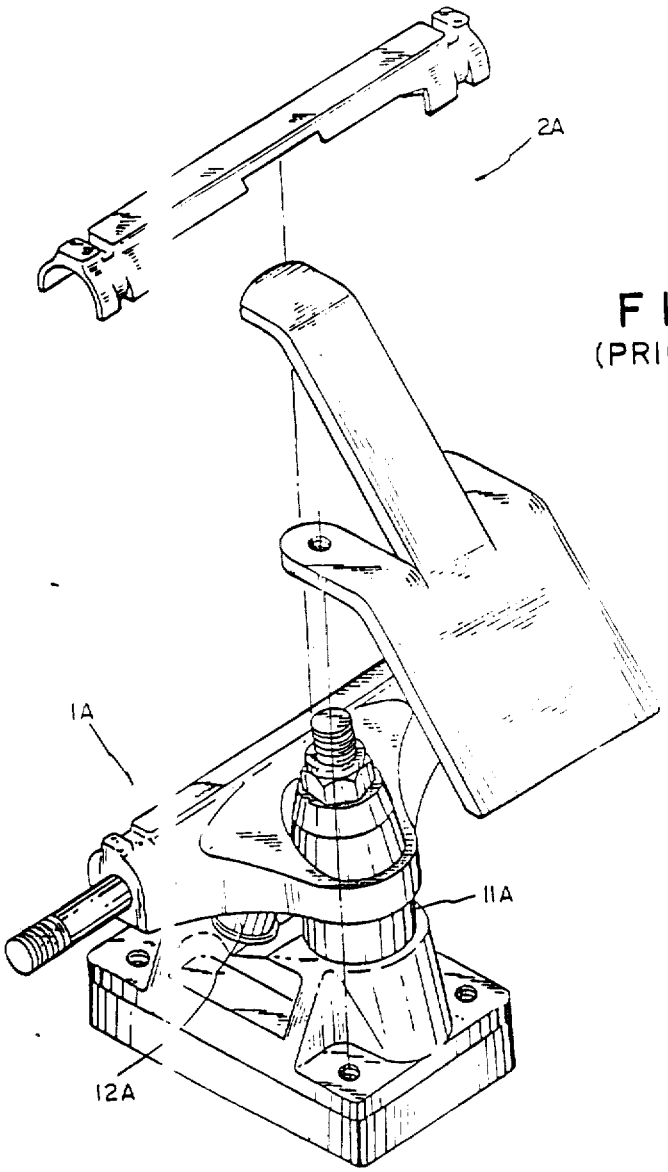
FIG. 1 (PRIOR ART)
Figure 2:
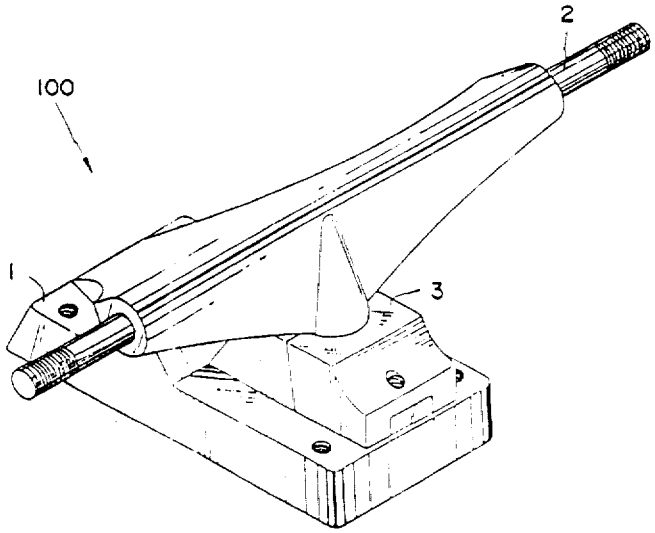
Figure 3:
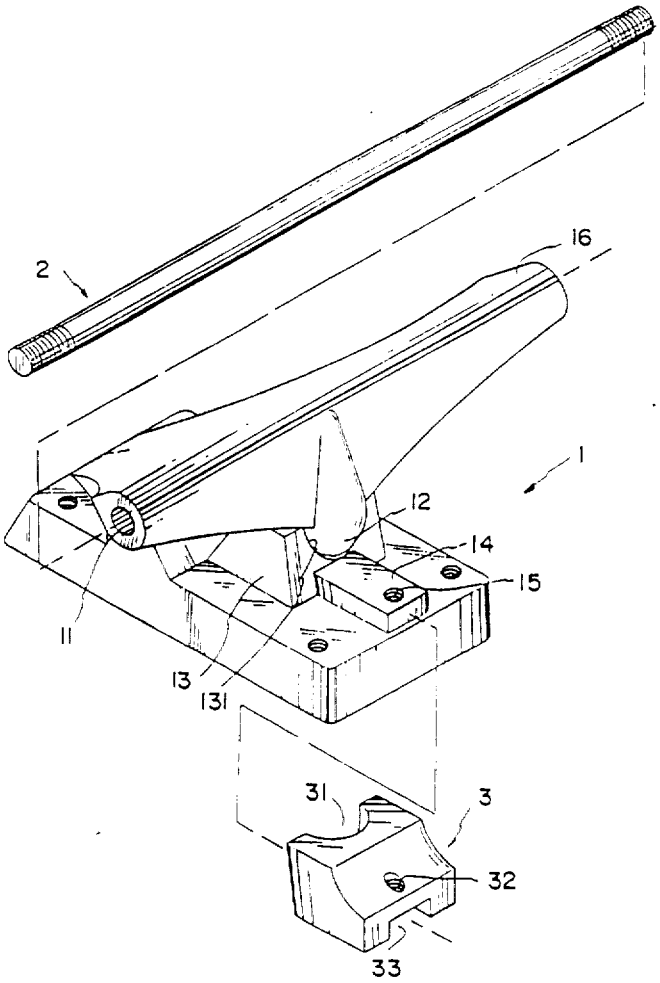
Figure 4:
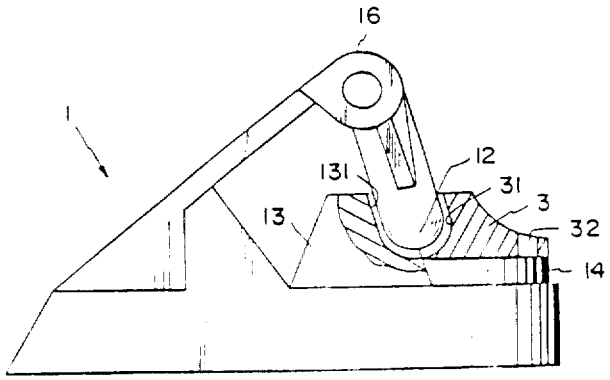

FIG. 2 illustrates a roller bracket according to the present inventon. All component parts of the present invention, except the shaft 2 and the PU fixed block 3, are all integrally made of nylon. As illustrated in FIGS. 3 and 4, the body 1 of the present invention has an inclined surface 100 extending in a first direction to an edge thereof and in a second opposite direction to form a nose-shaped surface 12 disposed between a recess 131 of the cushioning seat 13 and an edge 31 of the fixed block 3. The slot 33 of the fixed block 3 is slid on the convex portion 14 and the upper edge 16 is provided with a passage 11 for receiving the shaft 2.

As described above, the present invention utilizes the inclined surface 100 provided with high resilience and high torque resistance to replace the seat 1A, the locking rod structure 11A and the protection cover 2A, and the nose-shaped surface 12 to replace the stand 12A of the prior art. In addition, the nose-shaped surface 12 may be moved safely either in upward, downward, leftward and rightward direction between the cushioning seat and the fixed block.

Figure 5:
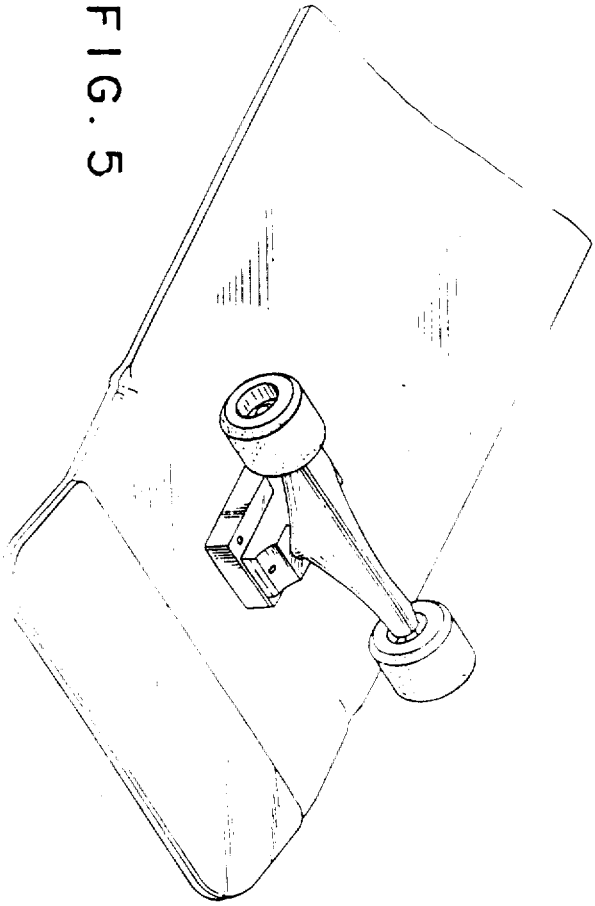
FIG. 5 shows how the invention roller bracket is fixedly mounted on the bottom of a skateboard.

FIG. 5 shows the way to mount the roller bracket according to the present invention on the bottom of a skating board.

I claim:

1. A roller bracket for a skateboard comprising:

a) an integrally formed body for attachment to a skateboard;

b) the body including an upper portion having a passage formed therein for receiving a shaft, a first inclined surface portion extending from the upper portion in a first direction to an edge of the body for sustaining forces and torque exerted by a user of the skateboard, a second surface portion extending from the upper portion in a second opposite direction and terminating in a nose-shaped portion, a cushioning seat provided with a first recess therein, and a convex portion positioned below the upper portion; and c) a block attachable to the convex portion, the block including a second recess formed therein, the first and second recesses corresponding in configuration for receiving the nose-shaped portion therein, and the cushioning seat and the block collectively serving to steady and control the upward, downward and sideward movements of the nose-shaped portion.

2. A roller bracket for a skateboard comprising:

a) an integrally formed body for attachment to a skateboard;

b) the body including an upper portion having a passage formed therein for receiving a shaft, a first surface portion extending from the upper portion in a first direction to an edge of the body for sustaining forces and torque exerted by a user of the skateboard, a second surface portion extending from the upper portion in a second opposite direction and terminating in a nose-shaped portion, a cushioning seat partially receiving the nose-shaped portion therein, and a convex portion positioned below the upper portion; and c) a block attachable to the convex portion for partially receiving the nose-shaped portion therein, the block including a slot within the convex portion is engaged, and the cushioning seat and the block collectively serving to steady and control the upward, downward and sideward movements of the nose-shaped portion.

* * * * *

UNITED STATES PATENT AND TRADEMARK OFFICE

CERTIFICATE OF CORRECTION

PATENT NO. : 5,054,797

DATED : October 8, 1991

INVENTOR(S) : Tsai Shuei-Lai

It is certified that error appears in the above-identified patent and that said Letters Patent is hereby corrected as shown below:

The title page showing the illustrative figure should be deleted and substitute therefor the attached title page.

Sheets 1-3 of the drawings should be deleted to be replaced with sheets 1-5 of drawings, consisting of figs. 1-5, as shown on the attached pages.

Signed and Sealed this

Fourth Day of February, 1992

*Attest:*

*Attesting Officer*

HARRY F. MANBECK, JR.

*Commissioner of Patents and Trademarks*

United States Patent [19]

Shuei-Lai

[11] Patent Number: 5,054,797

[45] Date of Patent: Oct. 8, 1991

[54] ROLLER BRACKET STRUCTURE FOR A SKATEBOARD

[76] Inventor: Tsai Shuei-Lai, No. 6, 21 Alley, 306 Lane, 2 Sec, Tai-Lin Rd, Tai-Shan Town, Taipei Hsien, Taiwan

[21] Appl. No.: 506,092

[22] Filed: Apr. 9, 1990

[51] Int. Cl.[5] ..... B62M 1/00

[52] U.S. Cl. ..... 280/11.28; 280/87.042

[58] Field of Search ..... 280/87.042, 87.021, 280/11.27, 11.28

[56] References Cited

U.S. PATENT DOCUMENTS 3,862,763 1/1975 Ware ..... 280/11.28

4,103,917 8/1978 Widolf ..... 280/11.28

*Primary Examiner*—Andres Kashnikow

*Assistant Examiner*—Richard Camby

*Attorney, Agent, or Firm*—Bacon & Thomas

[57] ABSTRACT

An improved roller bracket structure for a skateboard mainly constituted by an integral body made of nylon, a fixed block made of PU and a shaft. The integral body has an upper portion provided with a passage for receiving the shaft and the upper portion extends in a first direction along an inclined surface to the edge of the body for supporting the force and torque exerted thereon by the player, and extends in a second direction to form a nose-shaped portion for facilitating the control for the forward and sideward motions. Further, the fixed block is fitted on the body to buff and control the nose-shaped portion and maintain a safe operating condition.

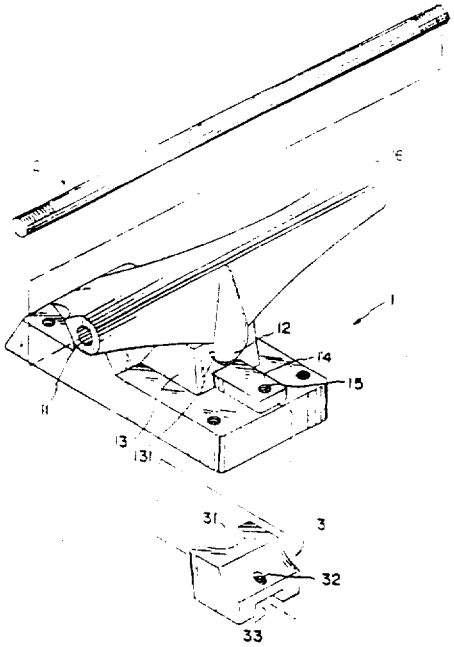

2 Claims, 5 Drawing Sheets